United States Patent [19]

Becker

[11] Patent Number: 5,044,528

[45] Date of Patent: Sep. 3, 1991

[54] ACTUATING DEVICE FOR A TAP ON A BEVERAGE DECANTING INSTALLATION

[76] Inventor: Carl M. Becker, Kalkstrasse 67, D-4030 Ratingen 4, Fed. Rep. of Germany

[21] Appl. No.: 482,559

[22] Filed: Feb. 21, 1990

[30] Foreign Application Priority Data

Mar. 3, 1989 [DE] Fed. Rep. of Germany ..... 3906836

[51] Int. Cl.[5] ..... B67D 3/04

[52] U.S. Cl. ..... 222/504; 222/505; 251/58; 251/63.4

[58] Field of Search ..... 222/344, 397, 544, 504, 222/505-509, 517, 518; 251/58, 63.4, 78

[56] References Cited

U.S. PATENT DOCUMENTS

| | | | |
|---|---|---|---|
| 3,221,936 | 12/1965 | Spinuzza | 222/504 X |
| 3,380,629 | 4/1968 | Kontra et al. | 222/504 X |
| 3,399,809 | 9/1968 | Simonich | 222/504 X |
| 3,524,383 | 8/1970 | Locke | 222/504 X |
| 4,226,343 | 10/1980 | Fling | 222/505 X |
| 4,549,675 | 10/1985 | Austin | 222/505 X |
| 4,898,308 | 2/1990 | Rudick | 222/504 X |

FOREIGN PATENT DOCUMENTS

| | | | |
|---|---|---|---|
| 0231578 | 12/1987 | European Pat. Off. | 222/505 |
| 199630 | 11/1965 | Sweden | 222/504 |

*Primary Examiner*—Michael S. Huppert
*Assistant Examiner*—Kenneth DeRosa
*Attorney, Agent, or Firm*—Marmorek, Guttman & Rubenstein

[57] ABSTRACT

The invention relates to an actuating device for a tap on a beverage decanting installation. The tap 1 bears a plug-in receptacle 5 with a non-return valve 8-10 of a connection 6, 7 for a pressurized gas pipe. Fitted on to the plug-in receptacle 5 is a casing 13 formed with connecting channels and connecting chambers 16, 18, 19, 21, 22, 28, 29 for the supply of a pressurized gas to an actuating piston 32 disposed in a chamber 30 for an actuating member 3 of the tap 1. When the casing 13 is fitted on, the non-return valve 8-10 accommodated in the plug-in receptacle 5 is retained in the open position by a tappet 16 of a connecting channel 18, so that the actuating piston 32 can experience pressure via another valve 25, 26, 27 actuable by a rocking lever 40. The other valve 25, 26, 27, constructed as a non-return valve, is actuated via a tappet 34 which takes the form of a valve and via which the chamber 30 of the actuating piston 32 can be relieved of pressure.

7 Claims, 3 Drawing Sheets

ACTUATING DEVICE FOR A TAP ON A BEVERAGE DECANTING INSTALLATION

BACKGROUND OF THE INVENTION

The invention relates to an actuating device for a tap on a beverage decanting installation, wherein the beverage is pressurized in a storage tank by a gas, more particularly carbon dioxide, and the tap can be moved out of the closure position and into the open position by means of an actuating member adjustable against the pressure of a spring.

An actuating device of this kind specified is known from German Utility Model 87 13 372. To ensure that the prior art actuating device operates, the actuating member must be connected by suitable constructional members to the tap to be opened and closed. The multipart construction is often rather expensive to assemble and disassemble .

German OS 30 45 254 discloses an actuating device for a beverage decanting installation, wherein two liquids can be withdrawing under the force of gravity from the tap by means of rocking levers, without the use of pressure. This prior art device requires no special devices adapted for use with a pressurized gas supply.

Another beverage decanting installation is known from German OS 15 32 651. In that installation the individual operating elements, such as the tap and the actuating device for the tap, must be attached individually inside a mounting and adjusted in relation to one another. Assembly is expensive in this case also.

SUMMARY OF THE INVENTION

It is an object of the invention to provide an actuating device of the kind described above which can readily be assembled on and demounted from the tap and in which the actuating member of the tap is actuated by servo-operation.

To this end, in an actuating device of the kind specified, disposed on a tap is a holder which takes the form of a plug-in receptacle and has a connection to a pressurized gas line. The holder is equipped with a first non-return valve which is opened when the pressurized gas is introduced into the receptacle. The actuating device further comprises a casing which has an actuating piston in a piston cylinder for moving the actuating member to open the tap, and connecting channels or chambers for introducing the pressurized gas into the piston cylinder. A second non-return valve disposed in one of the connecting channels/chambers regulates the introduction of pressurized gas into the piston cylinder. The casing is fitted onto the holder so that an inlet of the casing is sealingly connected to the first non-return valve and when it is opened, pressurized gas is introduced into the connecting channels/chambers.

The fitting of the casing onto the holder in the actuating device according to the invention on the one hand makes the connection to the pressurized gas from the connection in the holder, and on the other hand moves the actuating piston into position for actuating the actuating member. The actuating device further includes a manually operated rocking lever. The actuation of the rocking lever opens the valve incorporated in the connecting channels/connecting chambers and supplies the pressurized gas to the actuating piston, which moves the actuating member out of its closure position and into the open position, so that the pressurized beverage can flow out of the tap. The actuating device can therefor be moved into the operating position by a single manual movement.

According to an additional feature of the invention, the casing comprises a number of dish-shaped chambers disposed axis-parallel one beside the other which are connected on one side by a cover. A first of these chambers, connected directly or indirectly to the pressurized gas received in the holder, receives the valve member of the second non-return valve and is actuated by the rocking lever, while a second chamber of the casing constitutes the piston cylinder and receives the actuating piston. A baffle is disposed in one of the chambers.

A casing thus constructed is compact, can readily be produced by injection moulding and allows easy assembly. The connections between individual chambers can be very simply produced by injection molding with a further feature aspect, that a recess formed in that edge of the partition between adjacent chambers which is adjacent to the cover, forms the connection and/or the baffle between the adjacent chambers.

According to a further feature of the invention, after the actuation of the actuating member by the actuating piston, the piston can be very simply relieved of the pressure operating thereon by the feature that disposed in the connecting channel from the second non-return valve to the cylinder of the actuating piston is a third non-return valve actuable by the rocking lever. The third non-return valve is constructed as a tappet which bears via a spring against the valve member of the second non-return valve towards the rocking lever, a ventilating channel being formed in the body of the tappet. This feature of the invention can be produced by making the spring acting on the second non-return valve stronger than the spring acting on the tappet so that the second non-return valve closes first and only then can the pressure in the chamber in the piston cylinder be relieved via the ventilating channel in the tappet.

BRIEF DESCRIPTION OF THE DRAWINGS

An embodiment of the invention will now be described in greater detail with reference to the drawings, wherein.

DETAILED DESCRIPTION OF PREFERRED EMBODIMENT

Figure 1:
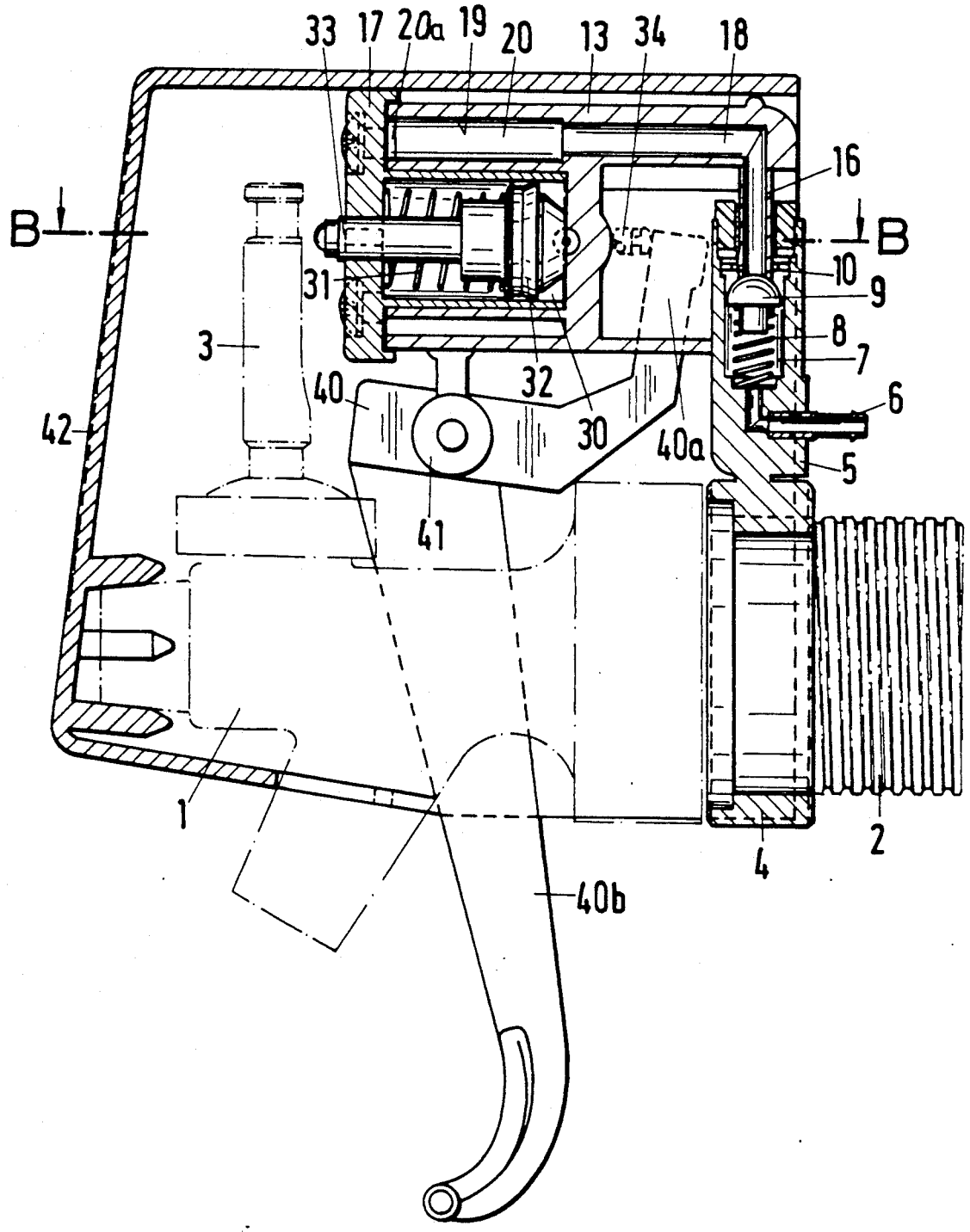
FIG. 1 shows an actuating device disposed on a tap, in vertical axial section along the line A—A in FIG. 2.

A tap 1 shown in dot and dash lines has a connecting spigot 2 via which it can be connected to a mounting of a beverage decanting installation. The tap 1 also has an actuating member 3 which can be pivoted against the pressure of a spring by means of which the tap 1 can be moved out of the closure position and into the open position.

Non-rotatably disposed via a ring 4 on the connecting spigot 2 is a plug-in receptacle 5 having a connection for a pressurized gas line. The connection comprises a small connecting tube 6, to which the pressurized gas line can be fitted, a channel 7 formed in the interior of the plug-in receptacle 5, and a non-return valve comprising a valve member 9 loaded by a spring 8 and a valve seat 10.

Figure 2:
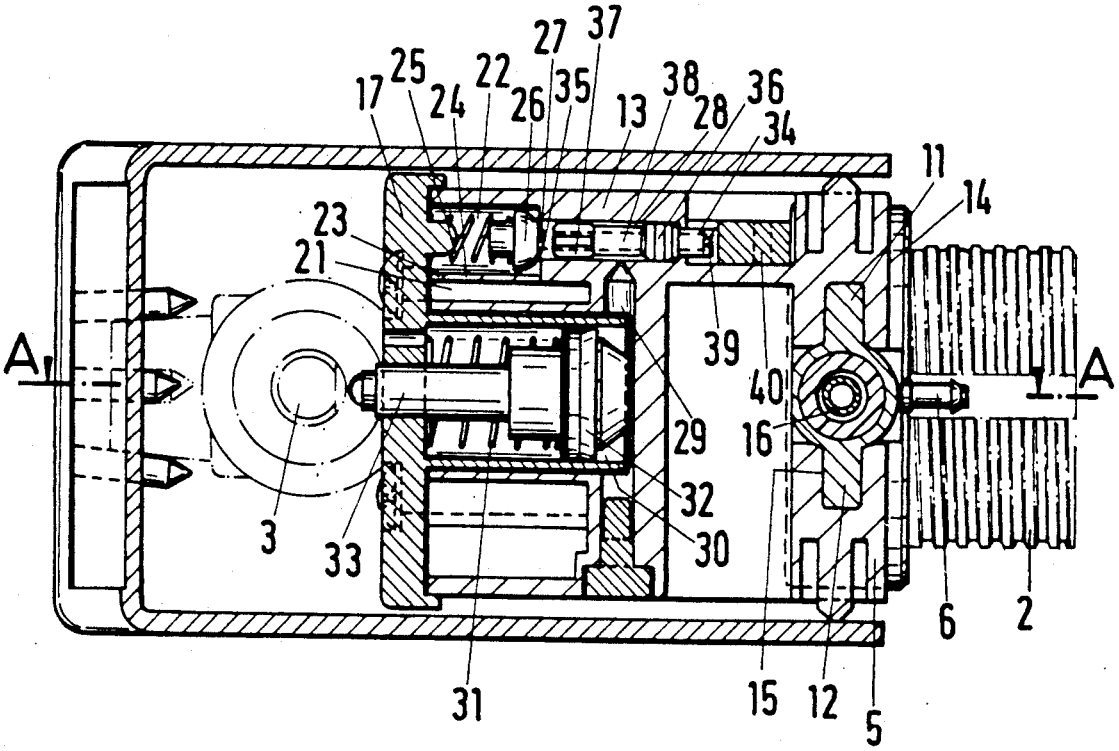
FIG. 2 is a horizontal section, taken along the line B—B in FIG. 1, through the actuating device shown in FIG. 1.

The plug-in receptacle 5 has lateral guide webs 11, 12 (see FIG. 2) onto which a casing 13 can be fitted by guide grooves 14, 15. When the casing 13 is fitted on, a connecting channel 16 taking the form of a tappet enters the plug-in receptacle 5 and lifts the valve body 9 off its valve seat 10, so that the pressurized gas can pass via the small tube 6, the channel 7 and the non-return valve 8, 9, 10 into the connecting channel 16.

The casing 13 is subdivided into a number of axis-parallel dish-shaped or channels which are hermetically sealed on the side adjacent the actuating member 3 by means of a common cover 17 attached by screws to casing 13. The connecting channel 18 disposed in the vertical central plane extends to a chamber 19, which is also disposed in the central vertical plane and is connected via a recess 20*a* formed in a partition 20 at an edge which is adjacent the cover 17. The partition 20 separates the chamber 19 from the adjacent chamber 21. The chamber 21 is connected to another chamber 22 via a small edge recess 23, acting as a baffle, in the partition 24 between the chambers 21, 22.

Accommodated in the chamber 22 is a non-return valve comprising a valve body 26 bearing against a spring 25 and its valve seat 27. From the chamber 22 a connecting channel 28 extends via a connecting channel 29 disposed transversely thereof to a chamber 30 containing an actuating piston 32 which bears against a spring 31 and acts on the actuating member 3 via a tappet 33 extending out of the casing 13.

A tappet 34 is slidably disposed in the connecting channel 28. Disposed between the valve body 26 and the tappet 34 is a return spring 35 whose force is lower than that of the spring 25. Between the connecting channel 29 and its end extending out of the casing 13, the tappet 34 is sealed off from the inside wall of the connecting channel 28 by a circumferential joint 36. At its end adjacent the valve body 26 and bearing against the inner wall, the periphery of the tappet 34 is formed with axially extending flattened portions 37, so that the space adjacent the valve body 26 and the space of the connecting channel 28 disposed in the zone of the connecting channel 29 are connected to one another. Lastly, an axial channel 38 extends through the tappet 34. The inlet of the channel 38, adjacent the valve body 26, forms a further valve seat for the valve body 26. The axial channel 38 discharges into a transverse bore 39, forming an outlet, outside the casing 13. For the purpose of axial displacement, the end of the tappet 34 extending out of the casing 13 is acted upon by an arm 40*a* of a two-armed rocking lever which is pivotably mounted in a bearing block 41 of the casing and whose other arm 40*b* can be manually pivoted by hand by a beaker or the like, into which a beverage is to be decanted.

The tap 1 including the casing 13 is enclosed within a box-like cladding 42.

Figure 3:
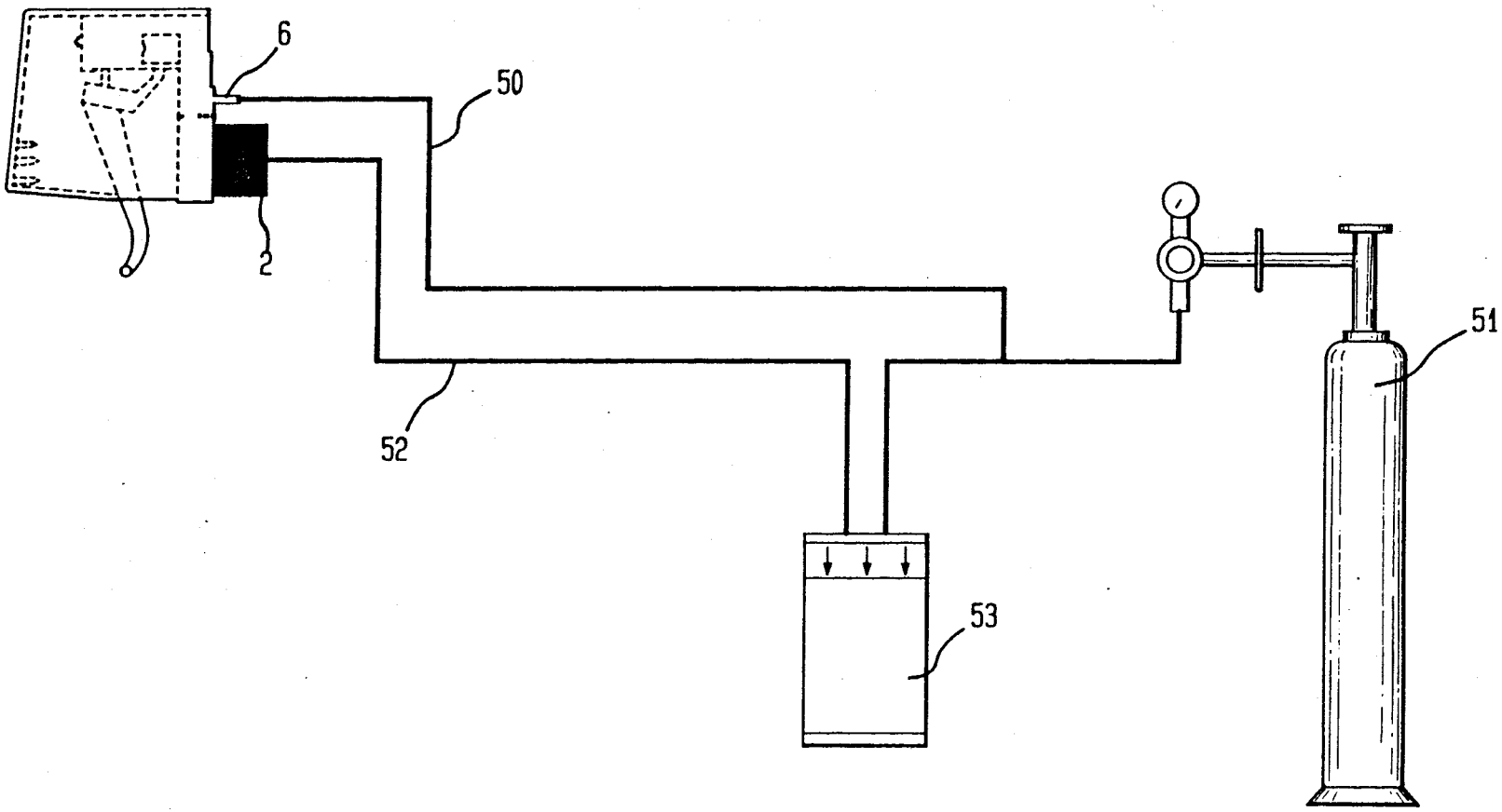
FIG. 3 is a schematic illustration of the actuating device shown in FIG. 1 connected to a storage tank.

FIG. 3 schematically illustrates the actuating device connected via spigot 2 and line 52 to the storage tank 53, and the small connecting tube 6 connected to the pressure source 51 via the line 50.

The actuating device according to the invention operates as follows:

With the casing 13 fitted onto the plug-in receptacle 5, the non-return valve 8–10 is opened, so that pressurized gas is present in the connecting channel 18 and the chambers 19, 21 and 22, the connection between the chambers 21 and 22 being produced via the baffle 23. In this configuration, the valve body bears against valve seat 27. If by the pivoting of the lever 40, the tappet 34 is now displaced in the direction of the valve body 26, firstly the weak spring 35 is compressed, so that the valve seat formed at the end face of the tappet 34 bears in sealing-tight relationship against the end face of the valve body 26. On further displacement of tappet 34 the valve body 26 is lifted off its valve seat 27, so that the pressurized gas can flow into the connecting channel 28 and via the connecting channel 29 into the chamber 30. However, due to the operation of baffle 23 the flow of pressurized gas is throttled, so that the piston 32 is not moved abruptly, but gently against the actuating member 3 which moves tap 1 from its closure position into its open position. The pressurized gas cannot flow away via the axial channel 38 in the tappet 34, since the tappet 34 bears in sealing-tight relationship against the valve body 26 at the end face. However, as soon as the pressure on the lever arm 40 is cancelled out, the valve body 26 and the tappet 34 bearing thereagainst are moved back by the spring 25. During the first phase of this movement, however, the end face of the tappet 34 still bears in sealing-tight relationship against the valve body 26. Only when the valve body 26 has reached its valve seat 27 and allows the passage of no further pressurized gas does the weaker spring 35 lift the tappet 34 off the valve body 26, so that the inlet of the axial channel 38 is opened. The pressurized gas contained in the chamber 30 can then flow off via the connecting channel 29 into the connecting channel 28, and between the flattened portions 37 and the inside wall of the connecting channel 28 into the space of the tappet 34 adjacent the valve body 26 and thence via its axial channel 38 to its outlet to atmosphere. Due to pressure being relieved in this way, the spring 31 can return the piston 32 with its tappet 33 to the starting position, so that the tap is again closed.

What is claimed is:

1. A device for decanting a beverage stored under pressure in a storage tank, comprising a frame connected to said storage tank, a tap connected to said storage tank and mounted adjacent said frame, said tap having a closed position and an open position through which said beverage is decanted, an actuating member disposed adjacent said tap for moving said tap from said closed position into said open position, a holder mounted in said frame, said holder comprising a plug-in receptacle including a connection for introducing pressurized gas into a pressure chamber of said receptacle and a first non-return valve located in said pressure chamber, said first non-return valve comprising a first valve member, a first valve seat, and a first spring urging said first valve member against said first valve seat, said first valve member being moved away from said first valve seat when pressurized gas is introduced into said pressure chamber through said connection, a casing mounted in said frame, said casing including a piston cylinder having an inlet, and an actuating piston and a piston spring disposed in said piston cylinder, said actuating piston being disposed opposite to said actuating member, said actuating piston being movable from a first position to a second position which causes said actuating member to open said tap when pressurized gas is introduced into said piston cylinder, said piston spring urging said actuating piston into said first position whereby said tap is normally closed, said casing further including a plurality of casing chambers leading to said inlet of said piston cylinder and a second non-return valve disposed in one of said chambers, said second non-return valve comprising a second valve member, a second valve seat, and a second spring urging said second valve member against said second valve seat whereby said second non-return valve is normally closed, said casing being mounted in said frame adjacent said holder so that when pressurized gas is introduced into said pressure chamber, said first non-return valve is opened and pressurized gas is introduced into said casing chambers through an inlet in said casing chambers, and means associated with said second non-return valve for opening said second non-return valve so that pressurized gas is introduced into said piston cylinder.

2. The device of claim 1 wherein said means for opening said second non-return valve comprises a rocking lever mounted on said frame opposite to said second non-return valve, said rocking lever being movable between a first position wherein said non-return valve is closed, and a second position wherein said second valve member is moved away from said second valve seat to open said second non-return valve so that pressurized gas is introduced into said piston cylinder to move said actuating piston into its second position and thereby to cause said actuating piston to open said tap.

3. The device of claim 2 further comprising a baffle disposed in one of said casing chambers to throttle the flow of pressurized gas into said piston cylinder when said second non-return valve is opened.

4. The device of claim 3 wherein said means for opening said second non-return valve further comprises a tappet disposed between said rocking lever and said second valve member, said tappet being moved from a non-engaged position when said rocking lever is in said first position to a position wherein said tappet is engaged against said second valve member when said rocking lever is in said second position.

5. The device of claim 4 further comprising means disposed on said tappet for engaging said second valve member in a sealing relationship.

6. The device of claim 5 further comprising a third spring disposed in one of said casing chambers urging said tappet into said non-engaged position and said rocking lever into said first position, said third spring being weaker than said second spring.

7. The device of claim 6 further comprising means disposed on said tappet for venting pressurized gas in said piston cylinder when said rocking lever is in said first position and said tappet is in said non-engaged position, so that said tap is normally closed.

* * * * *